US005724869A

United States Patent [19]

May

[11] Patent Number: 5,724,869

[45] Date of Patent: Mar. 10, 1998

[54] AUTOMATIC CORK REMOVER

[76] Inventor: Robert A. May, 521 E. 7th Ave., Salt Lake City, Utah 84103

[60]

[21] Appl. No.: 659,951

[22] Filed: Jun. 7, 1996

Related U.S. Application Data

[60] Provisional application No. 60/000,033, Jun. 8, 1995.

[51] Int. Cl.[6] ..... B67B 7/04

[52] U.S. Cl. ..... 81/3.2; 81/3.08; 81/3.29; 81/3.45

[58] Field of Search ..... 81/3.2, 3.08, 3.25, 81/3.33, 3.37, 3.29, 3.45, 3.48

[56] References Cited

U.S. PATENT DOCUMENTS

| | | | |
|---|---|---|---|
| 4,955,261 | 9/1990 | Chiang | 81/3.2 |
| 5,351,579 | 10/1994 | Metz et al. | 81/3.2 |
| 5,503,047 | 4/1996 | Brockington | 81/3.2 |

FOREIGN PATENT DOCUMENTS

| | | | |
|---|---|---|---|
| 2199813 | 7/1988 | United Kingdom | 81/3.2 |

*Primary Examiner*—D. S. Meislin

*Attorney, Agent, or Firm*—Trask Britt & Rossa

[57] ABSTRACT

An apparatus for removing a cork from a bottle is disclosed. The apparatus includes a housing, a motor disposed within the housing, and a corkscrew mechanically associated with the motor. An outer sleeve is associated with the housing. A shuttle is displaceably positioned within a channel defined in the outer sleeve. A slide, having a slot therein, is associated with the shuttle. The slot is configured to intercooperate with a rail positioned on the sidewall of the channel. The slide interacts with the rail to render the shuttle nonrotatable about its axis as the shuttle is displaced over a first length of the channel. In a second length of the channel, the shuttle is free to rotate about its axis. The corkscrew extends through a recess defined in the shuttle. A portion of a bottle containing a cork is received within the outer sleeve to engage the shuttle whereby the corkscrew may be inserted into the cork. An operation of the motor causes the corkscrew to be imbedded into the cork. Due to the interaction of the corkscrew and the shuttle, the cork is removed from the bottle.

21 Claims, 2 Drawing Sheets

AUTOMATIC CORK REMOVER

BACKGROUND OF THE INVENTION

1. Related Application

This application is related to U.S. Provisional application Ser. No. 60/000,033 filed 8 Jun. 1995.

2. Field of the Invention

The following invention relates to devices for the removal of corks from the necks of bottles, such as wine bottles. More particularly, this invention relates to automatic cork removers which are powered by a motor and which can be operated with a single hand on the device and without risk of pinching or otherwise injuring the user.

3. State of the Art

Corkscrews have long been known in the art for assisting in the removal of corks from the necks of bottles. Typically, the corkscrew includes a helically wound rigid wire with a sharp tip on one end and a handle for imparting torque at an opposite end. While this basic corkscrew is usually effective in removing the cork, it is notoriously difficult to use on many occasions. Not only does the corkscrew require significant strength to be threaded into the cork and to remove the cork thereafter, but also this chore is often significantly time consuming and can result in fragmented corks and other problems.

To address these problems, various improvements on the basic corkscrew are known in the art. Some improved corkscrews provide the user with leverage or an improved grip for manually extracting the cork. Typically, these devices require the use of two hands and still share many of the drawbacks of the basic corkscrew. Other improved corkscrews include a motor coupled to the corkscrew to assist the user in removing the cork. For instance the patent to Chaing, U.S. Pat. No. 4,955,261, provides an automatic corkscrew which allows a handle to be held still while a worm element rotates into the cork and extracts the cork from the bottle. Other similar devices include the automatic corkscrew of Spencer, Jr., U.S. Pat. No. 5,079,975; the corkscrew device of Bertram, U.S. Pat. No. 4,637,283; and the electric cork screw of Bocsl, U.S. Pat. No. 5,095,778.

While these motorized corkscrews do reduce an amount of effort needed to remove a cork from the neck of a bottle, they still suffer from a number of drawbacks. These devices include outer shrouds which telescope relative to a motor housing thereof. Such telescoping presents the possibility of pinching a hand of a user between the telescoping shroud and the motor housing. These devices require that a first hand be on the motor housing and that a second hand be on the outer shroud, enhancing the likelihood of injury. Also, these devices are typically bulky and heavier than a basic unpowered corkscrew, hence when they are dropped on the tip of the corkscrew, the tip is readily exposed and can damage the surface upon which the device is dropped. Accordingly, a need exists for a compact automatic cork remover which has an outer shroud which is stationary with respect to a motor housing and always remains below the tip of the corkscrew, and which can be operated with a single hand for added convenience.

SUMMARY

This invention provides an automatic electric corkscrew remover which allows for safe and simple removal of a cork from the neck of a bottle with a single hand of a user. The invention includes a motor oriented within a housing with an outer sleeve rigidly connected thereto and extending downward therefrom. The reversible motor has a rotatable output shaft oriented along a central axis of the outer sleeve with a corkscrew rigidly attached thereto. The outer sleeve extends below the tip of the corkscrew opposite the motor.

A cork receiving shuttle is oriented within the outer sleeve. The shuttle is a cylindrical tube which slides vertically within the outer sleeve. The shuttle has a inner recess. This recess may be tapered slightly to be wider at a bottom thereof, such that the recess is actually frustoconical. The shuttle includes an upper slide and a lower slide which are sized to slide along an inner surface of the outer sleeve. The outer sleeve includes at least one guide rail along a portion of the inner surface. The upper slide of the shuttle has at least one slot therein for each guide rail, allowing the upper slide to slide adjacent the guide rails of the inner surface of the outer sleeve without rotation. The guide rails have an upper end. When the upper slide of the shuttle passes above the upper end of the guide rails, the shuttle is allowed to rotate freely.

The inner frustoconical surface of the shuttle includes ribs. These ribs may be tapered at a bottom thereof with a slight taper and extending vertically therealong. The ribs prevent a cork oriented within the recess of the shuttle from rotating relative to the shuttle. A spring is interposed between the upper slide of the shuttle and a lower wall of the motor housing through which the corkscrew extends. The spring causes the shuttle to always be extended in a lowermost position, except when the rotation of the corkscrew causes a cork and bottle to be drawn against the shuttle, raising the shuttle. The shuttle is prevented from extending down out of the outer sleeve by a shelf having an inner diameter greater than a diameter of an outer cylindrical wall of the upper slide. The guide rails extend up from this shelf.

In operation, a user merely places the neck of the bottle, with a cork to be removed, into an open lower end of the outer sleeve and against a bottom wall of the shuttle. The bottom surface of the shuttle is contoured to be self-centering with bottles having variously sized neck. The shuttle can be moved upwards against the pressure of the spring until the corkscrew impacts the cork. The user can then activate the forward button on an exterior of the outer sleeve, activating the motor and causing the corkscrew to rotate. The corkscrew screws into the cork and draws the cork and bottle neck into the outer sleeve until the shuttle impacts a shuttle stop extending from the lower wall or force applied by the spring on the shuttle exceeds friction forces between the bottle and the cork. Further rotation of the corkscrew by the motor then causes the cork to be lifted out of the neck of the bottle and into the shuttle. The shuttle rotates freely until the motor is turned off or reversed.

Once the cork is free from the neck of the bottle, the cork can be removed from within the shuttle and housing by merely activating the reverse button. When the corkscrew rotates in the opposite direction, the spring causes the attached shuttle to impact the upper end of the guide rails until the slots in the shuttle upper slide engage the guide rails, halting rotation of the shuttle and hence the cork wedged within the recess thereof. Without rotation possible, the shuttle and cork is caused to translate off of the corkscrew and down through the outer sleeve. Once the upper slide abuts the shelf within the inner sleeve, the cork is caused to slide out of the shuttle and drop out of the device altogether.

Accordingly, it is a primary object of this invention to provide an automatic cork remover which includes no moving outer shroud and can be simply operated with a single hand, with the other hand optionally available to steady the bottle. Another object of the present invention is to provide an automatic cork remover which readily releases the cork after its removal from the neck of the bottle. Another object of the present invention is to provide an automatic cork remover which is driven by an electric motor which is lightweight and easily handleable and operable by users having various hand sizes and levels of manual dexterity. Another object of the present invention is to provide an automatic cork remover which halts upward movement of the cork on the corkscrew once the cork is out of the bottle, such that jamming of the cork within the corkscrew device is prevented. Another object of the present invention is to provide an automatic cork remover which is of simple construction, capable of manufacture from low cost durable materials and simple assembly in a compact housing. Another object of the present invention is to provide an automatic cork remover which does not present a risk of pinching or otherwise injuring a user and which has the tip of the corkscrew always nested within a rigid outer sleeve, so that the tip and other objects are kept from contacting each other and causing damage.

The above recited advantages, by way of example, provide many of the primary objects for this invention. In addition, various other objects will become apparent upon a careful reading of the specification as a whole.

DETAILED DESCRIPTION OF THE ILLUSTRATED EMBODIMENT

Figure 1:
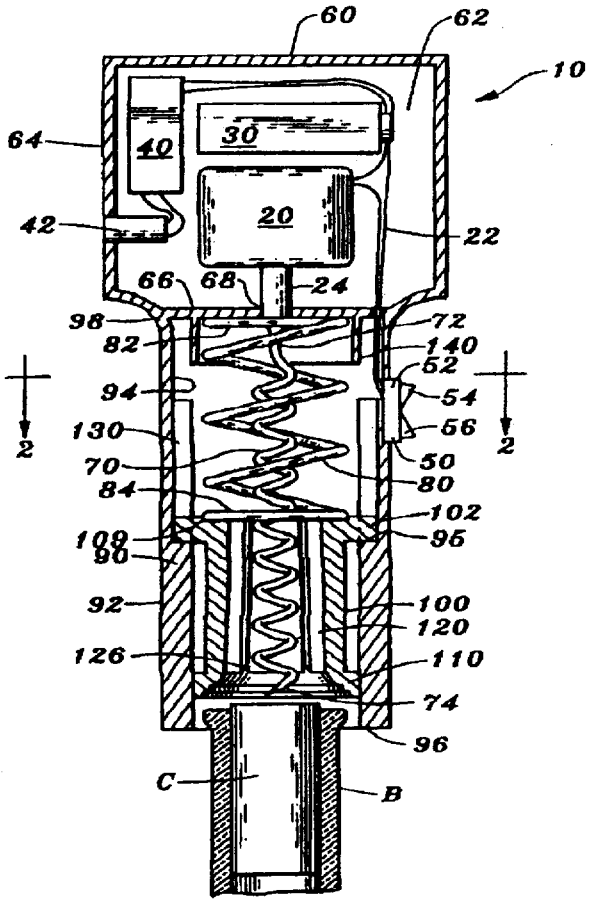
FIG. 1 is a full sectional view, of the automatic cork remover of this invention, with the plane in which the section is taken slightly forward of a central axis thereof and with portions thereof shown not in section to most clearly reveal their details.

With reference now to the drawing figures, wherein like reference numerals represent like parts throughout, reference numeral 10 is directed to an automatic cork remover (FIG. 1). The automatic cork remover includes a motor 20 which can cause a corkscrew 70 to rotate, removing a cork C from the neck of a bottle B.

In essence, and with reference to FIG. 1, the automatic cork remover 10 includes the electric motor along with a battery 30 and transformer 40 all oriented within a motor housing 60. A switch 50 allows a user to operate the motor 20 to cause the corkscrew to rotate in both directions. An outer sleeve 90 extends rigidly down from the motor housing 60, to a distance beyond a tip 74 of the corkscrew 70. A shuttle 100 is oriented within the outer sleeve 90 and is slideably supported therein by an upper slide 102 and a lower slide 110 coupled to the shuttle 100. The shuttle 100 has a recess defined by an inner frustoconical surface 120, with ribs 126, which is configured to frictionally receive the cork C therein. A spring 80 is oriented between a lower wall 66 of the motor housing 60 and the upper slide 102 of the shuttle 100 to bias the shuttle 100 toward a lower position.

The automatic cork remover 10 is operated by a single hand of the user by being placed with the outer sleeve 90 overlying a bottle B containing the cork C with the shuttle 100 adjacent the bottle B. The motor 20 is then activated, causing the corkscrew 70 to rotate and draw the cork C and shuttle 100 into the outer sleeve 90. When the shuttle 100 abuts a shuttle stop 140, the shuttle 100 stops translating upwards and the cork C is drawn out of the neck of the bottle B. The shuttle 100 and cork C can then rotate freely. The cork C is removed from the shuttle 100 by reversing the operation.

More specifically, and with particular reference to FIG. 1, details of the motor 20 and its operation are described. The motor 20 can be any type of motor capable of imparting rotation to an output shaft 24 with sufficient torque. Preferably, the motor 20 is a 6 volt reversible DC motor designed for relatively high torque operation while drawing a current below maximum amounts of current deliverable from a typical battery 30. Preferably, the battery is a set of four 1.5 volt alkaline or NiCd batteries having the standard battery designation "AA". However, any battery delivering electric power at the appropriate voltage and current levels can be used. Preferably, the battery 30 is of a rechargeable type for convenient long lasting operation without frequent battery 30 replacement.

The motor 20 preferably includes a gear reduction system coupled to the output shaft 24. This gear reduction decreases a speed and increases a torque delivered by the motor 20. Preferably, the gears are of a planetary type, to minimize the space devoted to gear reduction.

A transformer 40 is included within the housing 60 which can transform typical residential voltage from 110 volts AC to 6 volts DC for charging of the battery 30. A recharge interface 42 extends out of the motor housing 60 to allow simplified connection of the recharge interface 42 to a source of electric power within a residence or other location. The interface 42 can be in the form of two prongs which can plug directly into a standard electric outlet or be of a specialized nature to interface with a stand for the automatic cork remover 10 which is itself plugged into a standard electric outlet and provides simultaneous support for the automatic cork remover 10 and electric power for recharging the battery 30 through the interface 42 and transformer 40. As an alternative to the transformer 40 within the motor housing 60, the transformer can be oriented separate from the motor and the automatic cork remover 10 altogether. For instance, the interface 42 can be oriented adjacent and wired to the battery 30. The stand could then include the transformer or the transformer could be of other standard types, such as wall socket located transformers with a recharge power cord adapted to couple to the interface 42. By locating the transformer 40 out of the motor housing 60, the weight of the automatic cork remover 10 can be reduced.

Wiring 22 appropriately couples the motor 20 electrically to the battery 30 and to the switch 50 for user control of the motor 20. The wiring 22 also connects the transformer to the interface 42 and to the battery 30. Optionally, the transformer can also be wired directly to the motor 20 for use of the automatic cork screw 10 while it is plugged into a residential type power source through a power cord.

With further reference to FIG. 1, details of the outer sleeve 90 of the automatic cork remover 10 are provided. The outer sleeve 90 is essentially a hollow cylindrical construct extending rigidly down from the motor housing 60. The outer sleeve 90 has an outer surface 92 opposite an inner surface 94. Preferably, the outer surface is without any features disrupting the cylindrical contour thereof between a closed end 98 adjacent the motor housing 60 and an open end 96 opposite and below the closed end 98. The inner surface 94 has an inner shelf 95 which decreases an inner diameter of the outer sleeve 90 below the inner shelf 95 slightly. This inner shelf is substantially annular and of constant thickness. Hence, the outer sleeve 90 exhibits a thicker wall below the shelf 95 than above the shelf 95. Alternatively, the wall of the outer sleeve 90 can return to its original thickness both above and below the shelf 95 so that the shelf is cantilevered out from the inner surface 94 of the outer sleeve 90.

The inner surface 94 includes the switch 50 supported on the outer surface 92 thereof which allows a user to control operation of the motor 20. The switch includes a support 52 for the switch 50 allowing the switch to toggle between a neutral off position, a foreward position and a reverse position. The switch 50 preferably includes a cork up lobe 54 and a cork down lobe 56. Depression of the cork up lobe 54 causes the motor 20 to turn the corkscrew 70 forward, or clockwise for moving the cork C up and out of the bottle B. Depression of the cork down lobe 56 causes the motor 20 to turn the corkscrew 70 in reverse, or counter-clockwise for moving the cork C down out of the automatic cork remover 10. A wiring notch 58 is oriented between the switch 50 and the motor housing 60 on the inner surface 94 of the outer sleeve 90 to allow wiring 22 to connect between the motor 20 and the switch 50 without blocking movement of the shuttle 100 within the outer sleeve 90.

The inner surface 94 includes two guide rails 130, each extending up from the shelf 95 and adjacent the inner surface from a base 132 to an upper end 134. The guide rails are of rectangular cross section and constant width and thickness away from the inner surface 94. The two guide rails are oriented 180 degrees from each other. The upper ends 134 of the guide rails 130 terminate short of the shuttle stop 140 depending from the lower wall 66 of the motor housing 60.

With reference now to FIGS. 1–5, details of the shuttle 100 are described. The shuttle 100 is a rigid hollow cylindrical construct having an outer diameter similar to an inner diameter of the outer sleeve 90 and a height approximately half that of the outer sleeve 90. The shuttle 100 can thus slide up and down within the outer sleeve 90. The shuttle 100 includes an upper slide 102 at an upper end thereof and a lower slide 110 at a lower end thereof.

Figure 3:
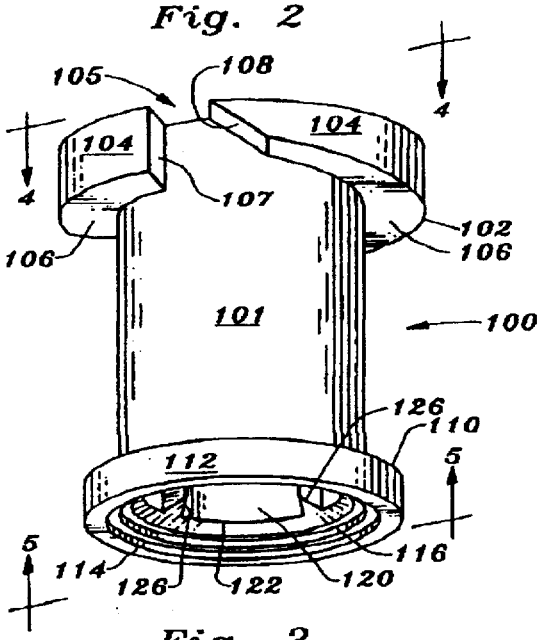
FIG. 3 is a perspective view of a shuttle portion of this invention which moves within an outer shroud of this invention and grasps the cork as it is drawn out of the neck of a bottle.
Figure 4:
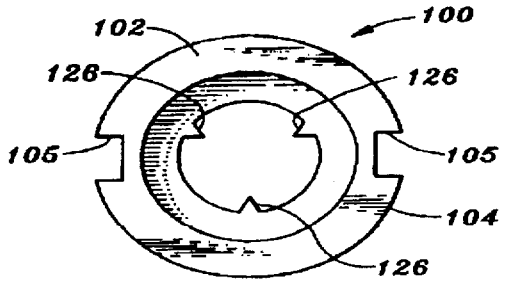
FIG. 4 is a top plan view of that which is shown in FIG. 3, taken along line 4—4 of FIG. 3.
Figure 5:
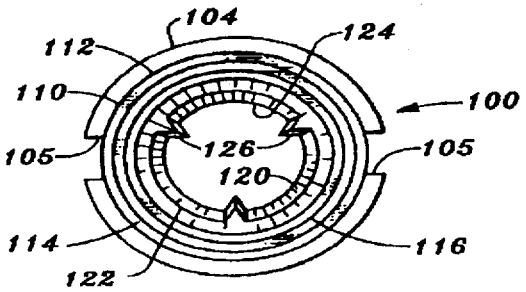
FIG. 5 is a bottom plan view of that which is shown in FIG. 3, taken along line 5—5 of FIG. 3.
Figure 6:
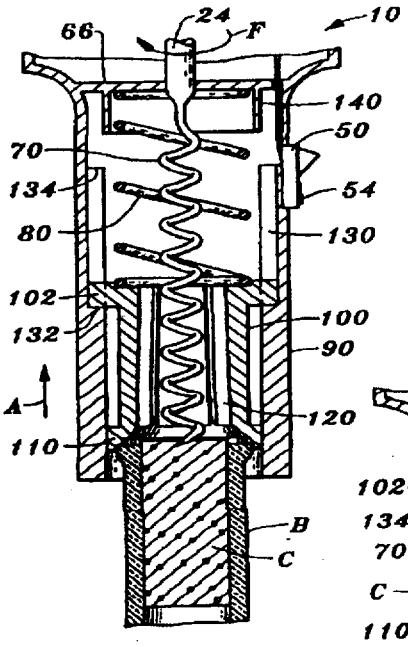
FIGS. 6–10 are sequential full sectional views of a portion of that which is shown in FIG. 1 revealing the various ships in removal of the cork from the neck of the bottle and then removal of the cork from the automatic cork removal device of this invention.
Figure 7:
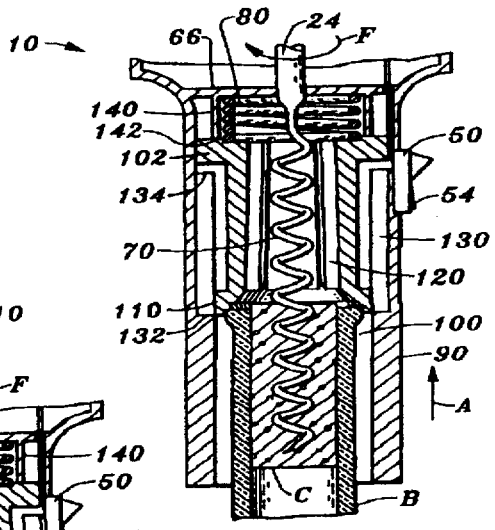
Figure 8:
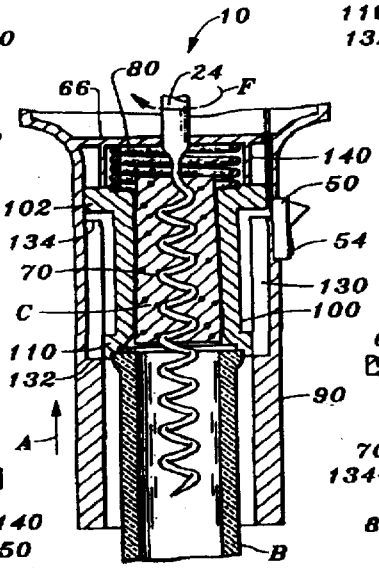

The upper slide 102 is an approximately annular lip extending outward from an outside surface 101 of the shuttle 100. The upper slide 102 includes an outer cylindrical wall 104 of a diameter similar to an inside diameter of the outer sleeve 90 above the shelf 95. The upper slide 102 extends down to a lower annular wall 106. The lower annular wall 106 is preferably slightly helical such that the upper slide 102 has a variable height about its circumference. Two slots 105 provide a gaps in the upper slide 102. The slots 105 are defined by a vertical slot face 107 on one side and a beveled slot face 108 of a second opposite side, as shown in FIG. 3. The lower annular wall 106 provides the upper slide 102 with a greatest height adjacent the vertical slot faces 107 and a least height adjacent the beveled slot faces 108. As shown in FIG. 1, the lower annular wall 106 abuts the shelf 95 of the outer sleeve 90 at times, preventing the shuttle 100 from falling out of the outer sleeve 90.

The slots 105 have a width at least as great as the guide rails 130 and are positioned to allow the upper slide 102 of the shuttle to pass along the guide rails 130 with the slots 105 running along the guide rails 130, preventing shuttle 100 rotation. When the upper slide 102 of the shuttle 100 passes above the guide rails 130, the shuttle 100 is allowed to rotate freely in a clockwise direction within the outer sleeve 90.

The lower slide 110 includes an outer peripheral wall 112 having a diameter similar to a diameter of the inner surface 94 of the outer sleeve 90 below the shelf 95. The lower slide 110 thus keeps the shuttle aligned vertically while translating vertically within the outer sleeve 90. The lower slide 110 includes a bottom wall 114 below the peripheral wall which includes a series of inverted terraces 116 thereon. The inverted terraces 116 are designed to allow the bottom wall 114 to effectively engage a neck of a bottle B to align the shuttle 100 with the bottles of various bottle sizes.

Alternatively, the lower slide 110 can have an increased height, extend as much as entirely up to the lower annular wall 106, in essence defining the outside surface 101 of the shuttle 100. If the shelf 95 is of a limited height, the lower slide 110 could have its peripheral wall 112 increased in diameter to match the diameter of the inner surface 94 below the shelf 95. Such a limited height shelf 95 could eliminate the need for the shuttle stop 140.

A hollow interior recess within the shuttle 100 is defined by a frustoconical surface 120. This frustoconical surface 120 is tapered to exhibit a lesser diameter at a top 124 than at a bottom 122. The diameter of the frustoconical surface is selected to be greater than most cork C diameters at the bottom 122 and less than most cork C diameters. Ribs 126 are provided vertically extending along the frustoconical surface from the bottom 122 to the top 124. Preferably three ribs are provided space 120 degrees from each other and having a triangular cross section. The ribs 126 are tapered at a bottom thereof. The ribs 126 assist in frictionally grasping the cork C as it is removed from the bottle B to prevent rotation of the cork C relative to the shuttle 100 at any time.

The hollow interior recess can alternatively be cylindrical and the ribs 126 can be tapered significantly from flush with the inner wall adjacent the bottom wall 114 to having a maximum thickness at the top 124. The ribs 126 would taper sufficiently to prevent a cork C from passing entirely through the shuttle 100. The shuttle both stops cork C vertical translation and cork C rotation when the cork C is free of the bottle B and is to be removed from the automatic cork remover 10. Other structures which could perform such a function with some success include prongs on the shuttle 100 and pointing downward from a top of the recess within the shuttle 100. Such prongs would stop the cork C from traveling upward within the recess and prevent the cork C from rotating when removal of the cork C from the automatic cork remover 10 is desired.

Figure 2:
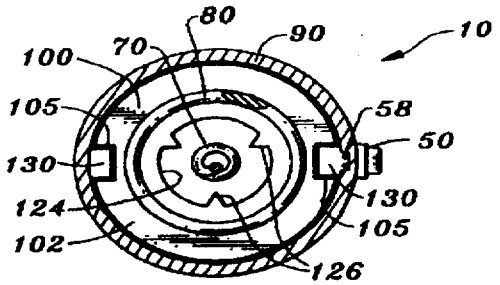
FIG. 2 is a sectional view taken along line 2—2 of FIG. 1.

With reference to FIGS. 1 and 2, details of a spring 80 of this invention are described. The spring 80 is of a helical compression type with a top end 82 adjacent the lower wall 66 of the motor housing 60 and a bottom end 84 adjacent the upper slide 102 of the shuttle 100 at all times. The upper slide 102 includes a circular trough 109 which aligns and supports the bottom end 84 of the spring 80 adjacent the shuttle 100. The spring 80 is oriented inboard from the shuttle stop 140 and has a minimum compressed height less than a height of the shuttle stop 140 from the lower wall 66 of the motor housing 60 to a lower end 142 of the shuttle stop 140. Thus, the upper slide 102 of the shuttle 100 abuts the lower end 142 of the shuttle stop 140 before the spring 80 is compressed to its minimum height. In an alternative construction, the shuttle stop 140 may be mounted on the upper surface of the shuttle 100. The spring 80 acts to hold the shuttle down against the shelf 95 except when sufficient force is applied upwards on the shuttle 100 to compress the spring 80.

With reference now to FIGS. 6–10, details of the use and operation of the automatic cork remover 10 are provided. Initially, the automatic cork remover 10, having a fully charged battery 30 (FIG. 1), is oriented adjacent of neck of a bottle B having a cork C to be removed. The automatic cork remover is placed with a central axis of the outer sleeve 90 aligned with a central axis of the neck of the bottle B and cork C until the bottle B abuts the bottom wall 114 of the shuttle 100. Depending on the diameter of a top of the neck of the bottle B, the inverted terraces 116 can engage the bottle B, aligning the bottle B and cork C with the shuttle 100. The automatic cork remover can then be translated downward until the tip 74 of the corkscrew 70 touches the cork C.

The user then depresses the cork up lobe 54 of the switch 50, causing the motor 20 to drive the output shaft 24 and attached corkscrew 70 in a forward, clockwise direction about arrow F. This rotation causes the corkscrew 70 to penetrate and auger into the cork C, causing the bottle B and cork C to be drawn up into the outer sleeve 90 of the automatic cork remover 10 along with the shuttle 100, along arrow A of FIG. 6. The spring 80 is chosen to exert a minimal force initially so that the corkscrew 70 rices not strip the cork C.

The corkscrew 70 continues to draw the cork C and attached bottle B upwards relative to the automatic cork remover 10 along arrow A until the upper slide 102 of the shuttle either abuts the shuttle stop 140 or a force exerted by the spring 80 on the shuttle, and hence the bottle B exceeds a frictional force between the bottle B and the cork C. At this point, the cork C is caused to be drawn out of the bottle B and up into the recess of the shuttle 100 defined by the inner frustoconical surface 120, along arrow A of FIG. 8. Note that once the cork C is free of the bottle B, the upper slide 102 of the shuttle 100 is also above the guide rails 130, so the cork C and shuttle 100 are allowed to rotate freely. This shuttle 100 rotation prevents the cork from being drawn further onto the corkscrew 70 and jamming into the lower wall 66 of the motor housing 60. The bottle B is now free of the cork C and the automatic cork remover 10 can be removed from the bottle B.

The only remaining operation is to remove the cork C from the automatic cork remover. The user initiates this process by depressing the cork down lobe 56 of the switch 50, causing the motor 20 and attached output shaft 24 and corkscrew 70 to rotate in reverse, counter clockwise, along arrow R of FIG. 9. This reverse rotation of the corkscrew 70 coupled with force applied by the spring 80 downward on the shuttle 100 cause the shuttle 100 and cork C to travel down within the outer sleeve 90 together until the upper slide 102 abut the upper end 134 of the guide rails 130. Further reverse rotation of the corkscrew 70 and attached cork C and shuttle 100 causes the vertical slot faces 107 of the slots 105 to impact the guide rails 130, causing the slots 105 to become aligned on the guide rails 130.

Figure 9:
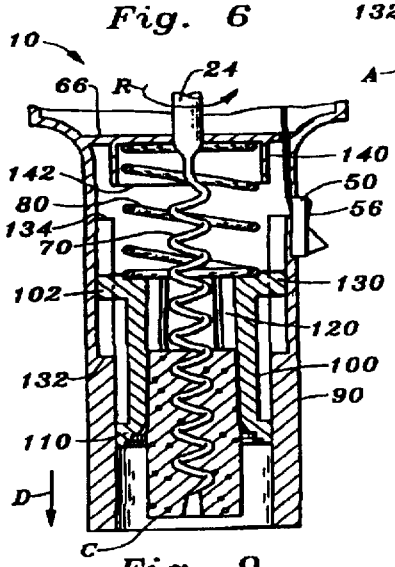
Figure 10:
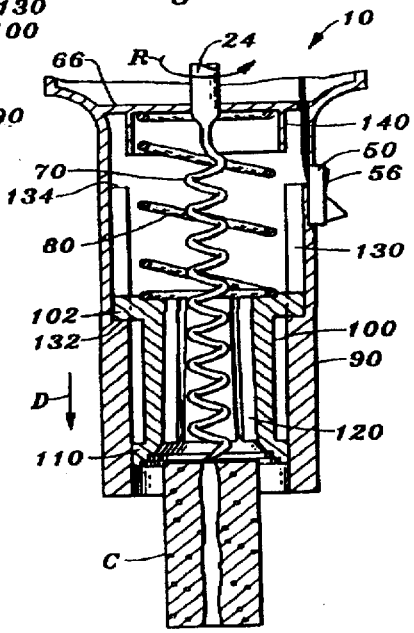

Further reverse rotation of the corkscrew 70 then causes downward translation of the cork C and shuttle 100 along arrow D of FIG. 9, because the cork C and shuttle 100 can no longer freely rotate. When the upper slide 102 of the shuttle abuts the shelf 95, the shuttle 100 becomes stationary and the cork C is pushed downward along arrow D of FIG. 10 and out of the recess defined by the inner frustoconical surface 120 of the shuttle 100. The automatic cork remover 10 is now ready for reuse on another bottle B and cork C. The entire process requires only the use of one hand on the automatic cork remover 10, and a second hand optionally on the bottle B. Also, the presence of the stationary outer sleeve 90 below the tip 74 of the corkscrew 70 at all times and the location of the shuttle 100 entirely within the outer sleeve 90, maximizes the safety of the automatic cork remover 10.

Moreover, having thus described the invention, it should be apparent that numerous variations to this preferred embodiment could be resorted to, but that such variations would still be within the scope and fair meaning of this invention as disclosed herein.

What is claimed is:

1. An apparatus for removing a cork from a bottle, said apparatus comprising:

a housing having an outer sleeve, said outer sleeve defining a channel having an open end;

a motor disposed in said housing;

a power supply electrically associated with said motor;

a corkscrew mechanically associated with said motor for rotation through operation of said motor;

a shuttle positioned within said outer sleeve channel for displacement along a length of said channel, said shuttle defining a recess therein for removably receiving said cork, said corkscrew extending into said recess, said shuttle having a longitudinal axis;

spring means associated with said shuttle for biasing said shuttle toward said open end of said channel; and a guide means for precluding a rotation with respect to said outer sleeve of said shuttle about its longitudinal axis when the shuttle is positioned in a first length of said channel while permitting a rotation of said shuttle about its longitudinal axis when said shuttle is positioned in a second length of said channel.

2. The apparatus of claim 1, wherein said guide means comprises at least one rail disposed on a sidewall of said channel and a slotted slide secured to said shuttle adapted to engage with said rail.

3. The apparatus of claim 1, wherein said spring means comprises a coil spring disposed in said housing intermediate said shuttle and said motor.

4. The apparatus of claim 1, wherein said shuttle includes retaining means for removably securing said cork within said recess.

5. The apparatus of claim 4, wherein said retaining means includes an upstanding structure disposed on a sidewall of said recess for engaging and releasably retaining said cork within said recess.

6. The apparatus of claim 4, wherein said recess is frustoconical in configuration.

7. The apparatus of claim 5, wherein said recess is frustoconical in configuration.

8. The apparatus of claim 1, wherein a stop is disposed within said channel for precluding the displacement of said shuttle within said channel beyond an established point.

9. The apparatus of claim 1, wherein said outer sleeve includes structure for retaining the shuttle within said channel.

10. The apparatus of claim 9, wherein said structure is a shelf configured proximate said open end to extend into said channel.

11. The apparatus of claim 1, wherein said shuttle includes an upper slide positioned on a first end of said shuttle and a lower slide positioned on a second end of said shuttle, said first shuttle having a slot therein configured to slidably receive a rail extending outwardly from a sidewall of said channel.

12. An apparatus for removing a cork from a bottle, said apparatus comprising:

a housing having an outer sleeve, said outer sleeve defining an elongate, cylindrical channel having an open end;

a motor disposed in said housing;

a power supply electrically associated with said motor;

a corkscrew mechanically associated with said motor for rotation through operation of said motor;

an elongate shuttle positioned within said outer sleeve channel for displacement along a length of said channel, said shuttle defining a rib lined recess therein for removably receiving said cork, said corkscrew extending into said recess, said shuttle having a longitudinal axis;

a coil spring positioned within said channel intermediate said shuttle and an end of said channel, said coil spring being associated with said shuttle for biasing said shuttle toward said open end of said channel;

a rail disposed on a sidewall of said channel and extending into said channel;

a slide positioned on said shuttle, said slide defining a slot therein configured to slidably receive said rail for precluding a rotation with respect to said outer sleeve of said shuttle about its longitudinal axis when the shuttle is positioned in a first length of said channel, said shuttle being rotatable with respect to said outer sleeve about said longitudinal axis of said shuttle when said shuttle is positioned in a second length of said channel.

13. The apparatus of claim 11, wherein said rib is angulated on at least one of its ends.

14. The apparatus of claim 11, wherein said recess defines a diameter which dimensionally decreases over a length of said recess.

15. The apparatus of claim 11, wherein said shuttle includes a second slide positioned spacedly from said slide.

16. The apparatus of claim 11, wherein outer sleeve includes a shelf proximate said open end for retaining said shuttle within said channel.

17. A method of removing a cork from a bottle, said method comprising:

providing a housing containing a motor driven corkscrew which extends through a shuttle, said shuttle being displaceable within a sleeve associated with said housing and biased within said sleeve by a spring;

positioning said sleeve over said bottle;

inserting said cork into a recess defined within said shuttle;

activating said motor to rotate said corkscrew in a first direction whereby said corkscrew is driven into said cork causing said shuttle to be displaced through said sleeve;

rendering said shuttle nonrotatable with respect to said sleeve through a first length of said sleeve to permit said corkscrew to become imbedded in said cork;

precluding said shuttle from being displaced within said sleeve beyond a certain location;

further rotating said corkscrew to lift said cork out of said bottle; and permitting said shuttle to rotate with respect to said sleeve and within said sleeve upon said shuttle being displaced beyond a certain location within said sleeve.

18. The method of claim 16, wherein said shuttle is precluded from displacement within said sleeve beyond a certain point by abutting said shuttle against a stop disposed within said sleeve.

19. The method of claim 16, wherein said shuttle is precluded from displacement within said sleeve beyond a certain point by applying a force on said shuttle exceeding the frictional forces between said bottle and said cork.

20. The method of claim 18, wherein said force is applied through means of said spring.

21. The method of claim 16, further including the steps of:

rotating said corkscrew in a second direction;

causing said shuttle to be displaced toward an open end of said sleeve;

rendering said shuttle nonrotatable about its axis;

further rotating said corkscrew to extricate said corkscrew from said cork; and removing said cork from said sleeve.

* * * * *